United States Patent [19]

Doelp et al.

[11] 4,075,082

[45] Feb. 21, 1978

[54] PROCESS FOR HYDRODESULFURIZATION AND LIQUEFACTION OF CARBONACEOUS STOCKS USING SUSPENDED CATALYST

[75] Inventors: Louis C. Doelp, Glen Mills; Lee Friedman, Bala Cynwyd; Maurice M. Mitchell, Wallingford, all of Pa.

[73] Assignee: Air Products and Chemicals, Inc., Allentown, Pa.

[21] Appl. No.: 714,035

[22] Filed: Aug. 13, 1976

Related U.S. Application Data

[63] Continuation-in-part of Ser. No. 594,883, July 10, 1975, Pat. No. 3,975,259.

[51] Int. Cl.[2] ..... C10G 1/08

[52] U.S. Cl. ..... 208/10

[58] Field of Search ..... 208/10, 11 R

[56] References Cited

U.S. PATENT DOCUMENTS

| | | | |
|---|---|---|---|
| 2,639,982 | 5/1953 | Kalbach | 208/11 R |
| 3,321,393 | 5/1967 | Schuman et al. | 208/10 |
| 3,565,751 | 2/1971 | Hoekstra | 208/11 R |
| 3,607,718 | 9/1971 | Leaders et al. | 208/10 |
| 3,813,329 | 5/1974 | Gatsis | 208/10 |
| 3,849,287 | 11/1974 | Gleim et al. | 208/8 |
| 3,923,634 | 12/1975 | Silvestri et al. | 208/10 |

*Primary Examiner*—Delbert E. Gantz
*Assistant Examiner*—James W. Hellwege
*Attorney, Agent, or Firm*—Thomas G. Ryder; E. Eugene Innis; Barry Moyerman

[57] ABSTRACT

A solid, sulfur-containing carbonaceous feedstock, e.g. coal or other high carbon content solid, in a finely divided form is suspended in a hydrocarbon liquid along with a finely divided hydroconversion catalyst having a nominal particle size of less than about 10 microns. The resulting suspension and a hydrogen-containing gas are contacted at an elevated temperature and pressure and at a weight hourly space velocity of between 200 and 50,000 kg. of the suspension per kg. of catalyst per hour. The resulting product is continuously withdrawn from the contact zone and normally gaseous materials are separated. A liquid product having a substantially reduced sulfur content and containing the finely divided catalyst is recovered as desulfurized product.

10 Claims, 1 Drawing Figure

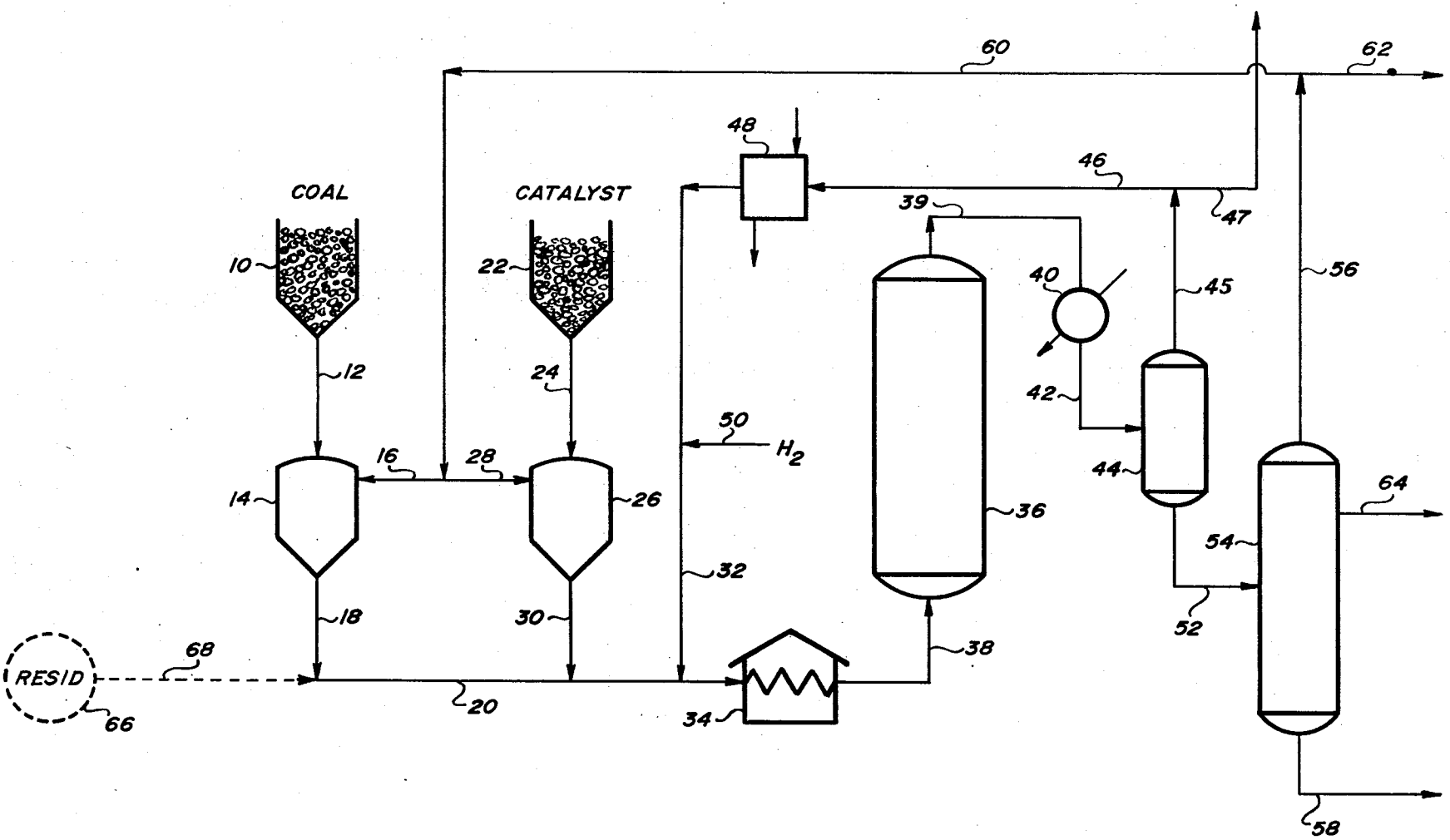
COAL
CATALYST
RESID
$H_2$
10
12
14
16
18
20
22
24
26
28
30
32
34
36
38
39
40
42
44
45
46
47
48
50
52
54
56
58
60
62
64
66
68

PROCESS FOR HYDRODESULFURIZATION AND LIQUEFACTION OF CARBONACEOUS STOCKS USING SUSPENDED CATALYST

RELATIONSHIP TO OTHER APPLICATIONS

This is a continuation in part of application Ser. No. 594,883, filed July 10, 1975, now U.S. Pat. No. 3,975,259.

BACKGROUND OF THE INVENTION

1. Field of the Invention

This invention relates to the hydrodesulfurization and liquefication of normally solid carbonaceous stocks with or without associated high boiling hydrocarbon feedstocks. More particularly, it relates to a hydrodesulfurization process employing a finely divided catalyst which remains in suspension throughout the process.

2. Description of the Prior Art

Prior art hydrodesulfurization processes traditionally have been carried out by passing the hydrocarbon feedstock downflow through fixed catalyst beds or upflow through an ebullating catalyst bed. The ebullating bed system is described in Layng et al, U.S. Pat. No. 3,533,105 and comprises introducing the liquid feedstock and hydrogen into the bottom of a contact zone containing either an extruded particulate catalyst ranging in size from 1/32 to 1/16 inches diameter or a microspheroidal catalyst ranging from about 20 to 325 U.S. mesh (841 to 44 microns). The feedstock is passed upwardly through a contact zone at a sufficient space velocity to expand the catalyst bed by at least 10%. The vapor and liquid products do not contain the catalyst and are removed from the top of the contact zone for phase separation and other downstream treatment. The catalyst in such a process must be periodically regenerated and recycled to the contact zone. This procedure involves a loss in production or on-stream time due to shutdown for catalyst regeneration or for replacement of the bed with fresh catalyst. In addition, hydrogen consumption in the prior art processes is high because of undesired hydrocracking and hydrogenation reactions due to the high resistance of hydrogen diffusion into the pores of the relatively large catalyst particles. Increased hydrogen diffusion rates which accompany the much smaller particles of the process of the present invention will reduce the undesired hydrogen consuming reactions.

A recent development in hydrodesulfurization has been the process described in Jacobsen, U.S. Pat. No. 3,841,996. In this process, a hydroconversion catalyst in particulate form having a typical particle size in the range from 0.02 to 0.5 mm (20 to 500 microns) is dispersed in the heavy petroleum feedstock and circulated within a reaction loop at a weight hourly space velocity (WHSV) of from 0.5 to 50 kg. of oil per kg. of catalyst per hour and at an elevated temperature and pressure to effect desulfurization. The feedstock must be circulated within the loop at a sufficient velocity to maintain the relatively large catalyst particles in the dispersion. The effluent from the reaction loop which still contains a portion of the catalyst is separated into a gas phase, a liquid product phase and a solid phase which contains that portion of the catalyst in the effluent in the form of a thick slurry in oil or a paste. This catalyst slurry or paste is recycled to the hydrodesulfurization process. Periodically the catalyst must be subjected to regeneration. Part of the spent catalyst is discarded and replaced with fresh catalyst. In view of the foregoing, this process has some of the same disadvantages as in the case with the traditional processes mentioned above to achieve the necessary process economics.

The prior art has disclosed much in the way of possible use and/or treatment of coals such as in formation of fluidizable fuels for direct use and as additives in liquid petroleum fuel supplies. Also taught are the numerous ways of converting coal to liquid form and as in U.S. Pat. No. 3,844,933 to Ronald H. Wolk et al of refining such coal extracts. However, no art appears showing the direct desulfurization of coals in conjunction with a small amount of extremely finely divided added catalyst which catalyst becomes and remains an acceptable part of the product.

SUMMARY OF THE INVENTION

In accordance with the process of this invention coal, or similar predominately carbonaceous solids, having sulfur as a substantial component thereof is liquified and reduced in sulfur content. This is accomplished by forming, in a liquid hydrocarbon, a combined suspension of the carbonaceous solids in the form of particles ranging in size from about 0.1 up to about 200 microns and a finely divided hydroconversion catalyst in the form of particles of less than about 10 microns in size. This combined suspension is then reacted with hydrogen under hydrogenating conditions of temperature, pressure, and residence time or space velocity to produce a hydrogen-treated material containing the catalyst. This hydrogen-treated material is then fractionated so as to separate a normally gaseous fraction from liquid materials, which contain the catalyst. The liquid material which contains the catalyst is then recovered as product of reduced sulfur content.

In forming the combined suspension the solid carbonaceous material generally will comprise from about 5% to about 90% by weight of the combined suspension, while the catalyst will be present in the suspension in an amount from about 50 to about 20,000 parts per million by weight based upon the quantity of solid carbonaceous material in the suspension. Usually, the solid carbonaceous solids will comprise from about 10% to about 75% and preferably from about 20% to about 60% by weight of the combined suspension, while the catalyst is preferably present in the suspension in an amount from about 500 to about 10,000 parts per million by weight based upon carbonaceous solid.

In the process of this invention the catalyst employed can be any one of the hydroconversion catalyst well known in the art including, for example, catalysts comprised of a hydrogenating component distended on a carrier, which may or may not have catalytic activity of its own. Generally, the hydrogenating component can be selected from the group consisting of Group VI and VIII metals, their oxides, their sulfides and mixtures thereof. Similarly, the carrier employed can be any one of the materials well known to the art including, for example, diatomaceous earths such as keiselguhr, clays, such as attapulgus clay, refractory metal oxides such as, for example, silica, alumina, magnesia, thoria, boria, zirconia and combinations thereof as well as zeolites such as the crystalline silica-alumina zeolites.

Broadly, the operating conditions employed for effecting the hydrogen treatment include a temperature from about 600° to about 900° F., preferably from about 700° to about 850° F.; a total pressure in the range from about 500 to about 3,000 p.s.i.g., preferably from about 1,000 to about 2,000 p.s.i.g.; a hydrogen partial pressure from about 400 to about 3,000 p.s.i.g., preferably from about 750 to about 2,000 p.s.i.g.; a hydrogen feed rate from about 1.0 to about 10.0 pounds of hydrogen per 100 pounds of combined suspension, preferably from about 2.0 to about 7.0 pounds of hydrogen per 100 pounds of combined suspension; and a residence time from about 0.2 to about 3.0 hours equivalent to an empty reactor suspension volume space rate of from about 0.2 to about 3.0 (suspension volume/empty reactor volume/hour) or a suspension weight hourly space velocity (WHSV) from about 200 to about 50,000 kg. of suspension/kg. of catalyst/hour.

In a particular embodiment of this invention a petroleum residuum can be incorporated in to the combined suspension prior to reaction of the suspension with hydrogen. In such situation the residuum is added to the suspension in a weight ratio to the carbonaceous solid in the range from about 1:1 up to about 10:1. As used herein, the term petroleum residuum is meant to describe the highest boiling, most difficultly vaporizable portion of the petroleum crude oil which normally will undergo thermal decomposition prior to vaporization. Under atmospheric conditions petroleum residuums normally are found to boil above about 700° F. and higher.

In various preferred embodiments of this invention the hydrogen treated material can be fractionated into a normally gaseous fraction, an intermediate liquid fraction boiling in the range from about 200° up to about 600° F. and a liquid fraction boiling above about 600° F. and containing the catalyst. The intermediate fraction boiling from about 200° to about 600° F. can be recycled and employed as the liquid hydrocarbon to form the combined suspension. Also the solid carbonaceous material can be subjected to a reduction in size, such as, for example, by grinding, either alone or in the presence of a liquid hydrocarbon such as the intermediate fraction boiling from about 200° to about 600° F. or in the presence of the petroleum residuum. Also the reaction between hydrogen and hydrocarbon can be effected by passing the hydrogen and combined suspension upwardly through a plug-flow reactor.

The concentration of the hydroconversion catalyst suspended in the feedstock generally ranges from about 10 to about 10,000 ppm (0.001 to 1.0% by weight), preferably from about 50 to about 5,000 ppm, on a once-through basis and is usually sufficiently low enough to remain in the desulfurized product sold to customer. Partial removal of solids may be desirable if the original carbonaceous solids have a high ash content and as the catalyst concentration approaches the 10,000 ppm level. If such removal is practiced, a variety of known methods such as filtration, or centrifuging can be employed.

It has been found that for a catalyst concentration in this low range, the oil-coal suspension is exposed to adequate catalyst surface area for simultaneous metals sorption and desulfurization to proceed to adequate levels of completion. It has also been found that it is desirable that the ratio of catalyst surface area to the weight of suspension be in the range from about 0.09 to about 7.0 $m.^2$/kg. of suspension (45–3500 $ft.^2$/100 lbs.) to achieve such adequate levels of completion. Thus, one is able to operate the present process at steady state conditions without the necessity of making temperature changes to accommodate for the deactivation of the catalyst. At the same time, overall catalyst losses are no greater than the catalyst consumption in conventional regenerative processes. This process avoids the necessity of the prior art steps of separating the catalyst from the liquid products, regenerating the catalyst and recycling the catalyst to the contact zone.

The effective life of the catalyst employed in the present process in general coincides with the residence time of the suspended catalyst within the contact zone. The catalyst and other solids in the suspension may have a residence time slightly greater than the residence time of the liquid in the contact zone because of rheological differences. However, such difference has no major effect on the results of this system which operates with a residence time in the range of about 5 to 180 minutes, preferably 15 to 120 minutes. This results in the full utilization of the effective life of the catalyst and in an avoidance of prior art problems associated with catalyst deactivation and poisoning through coking and accumulation of metals, metal salts and foreign sediment requiring separation, regeneration and/or related steps.

It has been found that the concentration of contaminant metals on large particle catalyst rapidly increases on the surface and thereafter inwardly as the radial distance of the catalyst increases. Thus, the larger particle catalyst may be effectively completely poisoned with metals when a high concentration accumulates on the surface and before a high concentration develops from the center to the shell of the catalyst. Such poisoning is independent from the deactivation by coke formation and is not susceptible to oxidative regeneration. For the very small catalyst particles used in this invention, a lower and more uniform metals poisoning concentration gradient is achieved at the same level of metals poisoning. In other words, the metals are much more evenly distributed throughout the catalyst pores rather than concentrated at or near the outer shell. This substantially improves the effective catalyst life as it coincides with coke formation and simply has to function on a once-through basis.

BRIEF DESCRIPTION OF THE DRAWING

The drawing is a schematic flow diagram of a specific form of hydrodesulfurization process of the present invention.

DESCRIPTION OF THE SPECIFIC EMBODIMENT

In the drawing, coal from supply source 10 is introduced through line 12 to a high shear wet pulverizer 14, while cycle oil is also introduced to pulverizer 14 through line 16. In pulverizer 14 the coal is reduced in size to particles no larger than 100 microns and in the presence of the cycle oil provides a suspended coal feedstock which is transferred through line 18 to charge stock line 20.

In an additional embodiment of this invention, a residual petroleum stock from supply source 66 can be passed by means of line 68 and admixed with the suspension in charge stock line 20; whereby the residual stock and the pulverized coal can be simultaneously hydrodesulfurized. When charging residual petroleum stock to the overall process, a reduction in the quantity of cycle oil employed can be effected. In a further alternative (not illustrated in the drawing) the residual stock can be substituted totally for the light cycle oil in the pulverization operations.

Hydrodesulfurization catalyst from supply source 22 is introduced through line 24 into high shear pulverizer 26 wherein it is admixed with a portion of light cycle oil introduced into pulverizer 16 through line 28. In pulverizer 26 the catalyst is reduced in size to particles of less than 10 microns suspended in the cycle oil and is thereafter transferred through line 30 into charge stock line 20 and admixed with the suspended coal feedstock. The required hydrogen for the hydrodesulfurization reaction is added through line 32 into admixture with the suspended coal feedstock and catalyst suspension in line 20 and forms the charge which is heated in heater 34 and is then introduced into hydrodesulfurization reactor 36 by means of line 38.

Reactor 36 provides in general the means whereby the 3-phase (i.e., gas-liquid-fine solid particles) charge moves upwardly therethrough in plug flow pattern, while simultaneously having planar lateral movement sufficient to maintain a measure of uniformity in the admixed charge during passage through the reaction zone of reactor 36. The reactor 36 may contain any of a variety of known flow control or flow assisting means, such as for example perforated plates, sieve trays, baffles, spargers, vanes, or other; the general purpose and intent being to provide conditions in the reactor generally assuring a measure of equality of reaction conditions for the three-phase system during passage through the reactor.

The effluent from reactor 36 is passed through line 39 and through heat exchanger 40 wherein the temperature of the effluent stream is lowered from the reaction temperature. The cooled stream from exchanger 40 is introduced via line 42 into gas-liquid separator 44 for separation of an off-gas stream containing light hydrocarbons, hydrogen, at least some of the hydrogen sulfide and other gaseous materials all of which are removed from separator 44 by means of line 45. The gaseous stream of line 45 is then divided and a portion thereof is passed by means of line 46 to scrubber 48 for the reduction of $H_2S$, while the balance of the stream of line 45 is removed from the system by means of line 47. The hydrogen containing gas stream of reduced $H_2S$ content is removed from scrubber 48 by means of line 32 from whence it is introduced into charge stock line 20, as explained previously. Fresh make-up hydrogen can be introduced into line 32 by means of line 50.

The liquid from gas-liquid separator 44 is passed through line 52 into fractionation column 54 wherein the liquid is separated into at least two fractions. As shown in the drawing, a light, overhead fraction is withdrawn from fractionating column 54 by means of line 56, while a heavy, bottoms fraction is withdrawn from column 54 by means of line 58. The light, overhead fraction of line 56 can be split into two streams with one stream of this light oil being cycled via line 60 to lines 16 and 28 and thus being introduced into the pulverizers 14 and 26, while the other stream can be removed from the system via line 62. Alternatively, the light cycle oil of line 62 can, if desired, be blended with the heavy, solids-containing, bottoms fraction of line 58. As a further alternative a side stream can be removed from column 54 by means of line 64 and such side stream can be recovered as a separate product of lower solids content and lower boiling range or it can be blended totally or partially with the high-solids content, high-boiling, bottoms fraction of line 58.

In order to illustrate this invention in greater detail reference is made to the following examples.

EXAMPLE I

In this example, Kentucky 14 coal containing 3.31 wt% sulfur and of about 100 micron size was ground in the presence of creosote oil to a size in the range from about 12 to 15 microns in order to form a creosote-oil slurry comprised of approximately 20% by weight by coal and 80% by weight creosote. The creosote contains 0.75 wt% sulfur and has an IBP of 400° F., a 5% point of 452° F., a 50% point of 595° F. and a 90% point of 730° F. at a pressure of 760 mm Hg. Three separate portions of the slurry of substantially equal quantity were taken. To two of these separate portions were added 8,000 parts per million of a catalyst of 2.5 microns in size and composed of 3% by weight nickel oxide and 15% by weight molybdenum oxide supported on an alumina carrier. Each of the three separate portions combined with a once through hydrogen stream was passed through an empty, ¾ inches diameter upflow reactor 5 feet long. The operating conditions common to all three runs included a temperature of 800° F., a pressure of 1200 p.s.i.g. and an LHSV of 2.0. The effluent from the reactor for each run was cooled and passed through gas-liquid separator from which separate liquid and gas streams were taken, measured and analyzed. The inspection data of the feed stock and product streams are shown in Table 1 below.

TABLE I

| Run No. | Feed | 1 | 2 | 3 |
|---|---|---|---|---|
| Catalyst, ppm (based upon coal & oil) | | 0 | 8000 | 8000 |
| Charge— | S.wt% | | | |
| Creosote, parts by wt | 0.75 | 80 | 80 | 80 |
| Coal, parts by wt | 3.31 | 20 | 20 | 20 |
| $H_2$, parts by wt | | 2.5 | 2.4 | 3.8 |
| S, parts by wt. | | 1.262 | 1.262 | 1.262 |
| Ratio of Catalyst surface area to weight of suspension | | 0.0 | 1.6 | 1.6 |
| $M^2$/kg. | | 0.0 | 1.6 | 1.6 |
| $ft^2$100 lb. | | 0.0 | 800 | 800 |
| WHSV, kg. suspension/ kg. cat/hr. | | 0 | 250 | 250 |
| Product— | | | | |
| Liquid-S, parts by wt | | 1.154 | 1.07 | 0.647 |
| % S removal | | 8.6 | 15.2 | 48.8 |
| Benzene Sol., wt % Coal & Oil | 80 | 93.1 | 92.7 | 94.9 |
| Benzene Insol., wt % Coal & Oil | 20 | 6.9 | 6.5 | 4.3 |
| Cat, wt % Coal & Oil | — | 0.0 | 0.8 | 0.8 |
| Total | | 100.0 | 100.0 | 100.0 |
| % Liquefaction of Coal | | 65.5 | 67.5 | 78.5 |

Examination of the data shown in Table 1 above show that when operating under the same conditions of temperature, pressure, and space velocity, an extremely small quantity of finely divided catalyst, as required by this invention, is effective to provide a slight increase in the liquefaction of the coal, while providing an increase of at least about 75% in the quantity of sulfur removed from the liquid product. It would also appear that a further increase in the quantity of hydrogen available seems to provide further substantial increases in both the quantities of sulfur removed as well as in the quantity of coal liquified.

EXAMPLE II

In this example a series of comparative runs were conducted in shaker microreactors employing operating conditions including a temperature of 800° F., a hydrogen pressure of 1300 p.s.i. and a reaction time of 90 minutes. In each run 10,000 parts per million by weight of 2–10 micron catalyst was employed. The particular catalyst utilized was comprised of 3% cobalt oxide and 15% molybdenum tri-oxide supported on alumina, which catalyst had been sulfided for 15 minutes at 200° F. In one set of runs the oil employed was a low metals content atmospheric residuum having an IBP of 508° F., a combined nickel and vanadium content of 307 ppm, an asphaltene content of 10.9% by weight and a sulfur content of 4.6% by weight. In another set of runs the oil employed was a creosote having a IBP of 410° F., a 65% point of 671° F. and a sulfur content of 0.72% by weight. A base run was conducted with each of these oils in which the finely divided catalyst was suspended but in which no coal was present. Comparative runs were then conducted employing suspensions in which finely divided coal passing through 100 mesh (0.15 mm) comprised 30% by weight of the total suspension with the balance being the oil. In all runs the ratio of catalyst surface area to weight of suspension (either with or without coal) was 6.1m²/kg. (3000 ft²/100 lbs.). Although the same particle size coal was employed in the suspensions of all the comparative runs two different techniques were employed for grinding the coal to the desired 100 mesh size. One of these techniques was merely to effect grinding of the coal in the presence of atmospheric air. In accordance with the other technique the coal was ground in a glove bag in an inert atmosphere and introduced directly into the oil without coming in contact with any air. This latter technique produces what is termed "inert ground" coal as distinguished from "air ground" coal. In all of the comparative runs, however, the coal employed was the same mixture of Kentucky 9/14 having a sulfur content of 4.37% by weight. The results obtained with these various runs are shown in Table 2 below.

TABLE 2

| Suspending Oil | Coal | Wt.% Coal | Desulfurization Oil, Wt.% | Desulfurization Coal Wt.% (Calc.) |
|---|---|---|---|---|
| Atmos. Resid. | None | 0 | 39 | — |
| Atmos. Resid. | Air Ground | 30 | Assumed to be 39 | 60 |
| Atmos. Resid. | Inert Ground | 30 | Assumed to be 39 | −7 |
| Creosote | None | 0 | 43 | — |
| Creosote | Air Ground | 30 | Assumed to be 43 | 48 |
| Creosote | Inert Ground | 30 | Assumed to be 43 | 66 |
| | Average of duplicate runs in all cases | | | |

From the data shown in Table 2 above it can be seen that when finely divided coal is incorporated into the colloidal suspension of finely divided catalyst in oil, either a heavy petroleum residual stock or a lighter creosote, the process of this invention is effective to provide substantial desulfurization of such coal. It will also be noted that when operating with the lighter creosote as the suspending oil, a further increase in the desulfurization of the coal can be effected, if such coal is ground in an inert atmosphere prior to addition to the suspension.

EXAMPLE III

In this example a plurality of runs were conducted employing varying quantities of hydrogen but maintaining the other operating conditions the same which conditions included a temperature of 425° C., a pressure of 1200 p.s.i. and an oil to coal ratio of 4 to 1. In these runs the catalyst was a 3% cobalt oxide and 15% molybdenum tri-oxide on an alumna carrier which had been reduced to particles ranging in size from 2 to 10 microns and having an average size of 5 microns. The catalyst was prepared as a suspension of 5.3% by weight catalyst in creosote. The coal was the same Kentucky 9/14 mixture of Example II and was prepared in the form of a suspension of 25% by weight coal in creosote. These two suspensions were then combined and introduced into a stirred reactor, after which the reactor was heated up to operating temperature over a period of 75 minutes. The reactor was maintained at this temperature for a reaction time of 60 minutes during which time the combined suspension were stirred at a rate of 1200 r.p.m. The hydrogen was introduced as a continuous stream during the reaction period in each of the runs so as to provide separate runs wherein the quantity of hydrogen employed was nominally 2%, 4%, 6% and 8% by weight based upon the combined suspension. The ratio of catalyst surface area to weight of combined coal and oil was 6.5 m²/kg. (3200 ft²/100 lb.).

In order to effect a separation of liquid and solids, the hydrogen treated product, after separation of gas, was subjected to filtration using 2–10 micron media. This permitted separate determination of sulfur content of solid and liquid products. The particular quantities of materials charged and product inspections for the separate runs are shown in Table 3 below.

TABLE 3

| Run No. | 1 | 2 | 3 | 4 |
|---|---|---|---|---|
| $H_2$, % by wt. | 2.0 | 4.1 | 6.1 | 8.1 |
| Charge— | | | | |
| Cat, g. | 5.46 | 5.23 | 5.31 | 5.30 |
| Coal, g. | 99.95 | 100.20 | 99.65 | 100.03 |
| Oil, g. | 397.49 | 394.07 | 393.84 | 394.78 |
| S in coal, g. | 4.368 | 4.379 | 4.355 | 4.371 |
| S in oil, g. | 2.862 | 2.837 | 2.836 | 2.842 |
| Total S, g. | 7.230 | 7.216 | 7.191 | 7.213 |
| Product-- | | | | |
| Filter cake g. | 38.40 | 41.50 | 41.40 | 40.10 |
| Filtrate, g. | 446.80 | 445.60 | 446.80 | 447.10 |
| Condensible gases, g. | 8.60 | 9.31 | 10.17 | 7.83 |
| S in filter cake, g. | 1.571 | 1.677 | 1.743 | 1.500 |
| S in filrate, g. | 2.498 | 2.611 | 2.364 | 2.696 |
| % starting S in filter cake | 21.73 | 23.24 | 24.24 | 20.80 |
| % starting S in filtrate | 34.55 | 36.18 | 32.87 | 37.38 |
| Total starting S in prod., % | 56.28 | 59.42 | 57.11 | 58.17 |
| % Unconverted coal | 8.1 | 15.1 | 13.8 | 9.4 |
| $H_2$ consumption, ft³ | 0.60 | 0.16 | 0.24 | 0.40 |

The data shown in Table 3 above illustrates the operation of this invention and the results obtained when employing a wide range of hydrogen concentrations going up to as high as about 8% by weight, base upon the total coal-oil suspension. From these data it can be seen that significant total desulfurization of both coal and oil is effected at all levels of hydrogen employed. Further, it will be noted that significant liquefaction of the coal is also effected at all levels of hydrogen feed rate. It should be explained that the experimental procedures employed did not permit of a total recovery of all products from these runs. Accordingly, a complete material balance of charge and product data cannot be accomplished, however, product recovery averaged generally above about 95% by weight.

We claim:

1. A process for desulfurizing and liquefying coal or a similar solid, sulfur-containing carbonaceous material which process comprises:

a. forming, in a liquid hydrocarbon, a combined suspension of the solid carbonaceous material in the form of particles having a major dimension in the range from about 0.1 to about 200 microns and a finely divided hydroyenation catatlyst consisting essentially of particles having a major dimension less than about 10 microns, b. reacting the combined suspension with hydrogen under hydrogenating conditions of temperature, pressure and a weight hourly space velocity (residence time) from about 200 to about 50,000 kg. of suspension per kg. of the catalyst per hour to produce a hydrogen-treated material containing the catalyst, c. fractionating the hydrogen-treated material to separate a normally gaseous fraction from liquid materials containing solids, and d. recovering the liquid containing the solids as product of reduced sulfur content.

2. The process of claim 1 wherein the solid carbonaceous material comprises from about 5% to about 90% by weight of the combined suspension.

3. The process of claim 1 wherein the catalyst is present in the combined suspension in an amount from about 50 to about 20,000 parts per million by weight based upon the quantity of solid carbonaceous material in the combined suspension.

4. The process of claim 1 wherein, prior to reaction with the hydrogen, a petroleum residuum is incorporated into the combined suspension in a weight ratio to the carbonaceous solid in the range from about 1 to 1 to about 10 to 1.

5. The process of claim 1 wherein the hydrogen-treated material is fractionated into a normally gaseous fraction, an intermediate liquid fraction boiling in the range from about 200° to about 600° F. and a liquid fraction boiling above about 600° F. and containing the catalyst and employing said fraction boiling from about 200° to about 600° F. as the liquid hydrocarbon used to form the combined suspension.

6. The process of claim 1 wherein the solid carbonaceous material is reduced to particles of the designated size while in contact with a hydrocarbon stock in order to form a first suspension and the finely divided catalyst particles are added to the first suspension to form the combined suspension.

7. The process of claim 1 wherein the hydrogenation catalyst comprises a hydrogenating component supported on a carrier, the hydrogenating component being selected from the group consisting of Group VI and VIII metals, their oxides and their sulfides.

8. The process of claim 1 wherein the combined suspension is reacted with hydrogen at a temperature from about 600° to about 900° F., a total pressure from about 500 to about 3,000 p.s.i.g., a hydrogen partial pressure from about 400 to about 3,000 p.s.i.a., a hydrogen feed rate from about 1.0 to about 10.0 pounds of hydrogen per 100 pounds of combined suspension and a residence time from about 0.2 to about 3.0 hours.

9. The process of claim 1 wherein the reaction is conducted by passing the hydrogen and combined suspension upwardly through a plug-flow reactor.

10. The process of claim 1 which further includes separating the solids from the liquid of step (d) and recovering the substantially solids-free liquid as product.

* * * * *

UNITED STATES PATENT AND TRADEMARK OFFICE

CERTIFICATE OF CORRECTION

PATENT NO. : 4,075,082

DATED : February 21, 1978

INVENTOR(S) : Louis C. Doelp, Lee Friedman, Maurice M. Mitchell

It is certified that error appears in the above-identified patent and that said Letters Patent are hereby corrected as shown below:

Column 5, Line 2
Delete "16" and substitute therefor -- 26 --

Column 9, Line 21
Delete "hydroyenation catatlyst" and substitute therefor -- hydrogenation catalyst --

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*